US006651387B2

(12) United States Patent
Choi

(10) Patent No.: US 6,651,387 B2
(45) Date of Patent: Nov. 25, 2003

(54) LOCKING CONTROLLER OF A SLIDING DOOR

(75) Inventor: Jae-hong Choi, Namyangju-shi (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 09/782,362

(22) Filed: Feb. 13, 2001

(65) Prior Publication Data

US 2002/0056232 A1 May 16, 2002

(30) Foreign Application Priority Data

Nov. 14, 2000 (KR) ..... 2000-67375

(51) Int. Cl.[7] ..... E05F 15/00
(52) U.S. Cl. ..... 49/280; 49/360; 292/341.16
(58) Field of Search ..... 49/279, 280, 360, 49/213, 214; 292/201, 341.16

(56) References Cited

U.S. PATENT DOCUMENTS 4,617,757 A * 10/1986 Kagiyama et al. ..... 494/280
4,848,031 A * 7/1989 Yamagishi et al. ..... 49/280
5,605,363 A 2/1997 Kapes
6,032,987 A * 3/2000 Fukumoto et al. ..... 292/216
6,176,528 B1 * 1/2001 Taga ..... 292/341.16
6,223,468 B1 * 5/2001 Kobayashi ..... 49/280
6,276,743 B1 * 8/2001 Jyawook et al. ..... 296/155
6,332,634 B1 * 12/2001 Fukumoto et al. ..... 292/201

* cited by examiner

*Primary Examiner*—Gregory J Strimbu
(74) *Attorney, Agent, or Firm*—Davis & Bujold, PLLC

(57) ABSTRACT

A locking controller mounted inside a sliding door. The locking controller is operated in connection with an inner handle resiliently returned to a neutral position when being turned in a door opening direction or in a door closing direction. If the inner handle is pulled or pushed in the door opening direction in the state that the sliding door is closed, the inner handle is turned in the door opening direction from the neutral position to release a door-close maintaining mechanism. If the inner handle is pulled or pushed in the door closing direction in the state that the sliding door is open, the inner handle is turned in the door closing direction from the neutral position to release a door-open maintaining mechanism. Therefore, a simple operation that the inner handle is turned in one direction makes the opening or shutting of the sliding door possible.

3 Claims, 3 Drawing Sheets

LOCKING CONTROLLER OF A SLIDING DOOR

BACKGROUND OF THE INVENTION

1. Field of the Invention

The present invention relates to a locking controller mounted inside a sliding door, and more particularly, to a locking controller of a sliding door, which is operated in connection with an inner handle turned into the door opening direction or into the door closing direction to control a gripped condition of an door-open maintaining means or a door-close maintaining means.

2. Description of the Related Art

A sliding door mounted on a van type car is in a sliding type that it slides in the back and forth direction of a car body along the side surface of the car body to be opened or shut. Therefore, passengers can get in or off the car easily and the opening and shutting of the door is not interfered from the surroundings even in a small area.

Identically with a general hinged door, the conventional sliding door includes a door-close maintaining means for maintaining a closed state of the door, a locking controller connected to the door-close maintaining means to control the operation of the door-close maintaining means, inner handle assembly and outer handle assembly connected to the locking controller to release the door from the closed state, and a door locking knob connected to the locking controller for controlling the locking controller to lock the door in the closed state. If the door opened is closed, the door is automatically fastened by the door-close maintaining means not to be opened. When inner and outer handles are operated in the state that the door is closed, the door-close maintaining means is released to open the closed door. When the door locking knob is operated, the door is not opened even though the inner and outer handles are operated in the state that the door is closed.

However, in the conventional sliding door, if the door is opened in the state that the car is parked on a slanted road surface, the door is automatically closed while sliding by self-weight, thereby the passenger may be injured by the automatically closed door. To prevent the problem, the passengers must hold the opened door.

To solve the problem, a method for installing a door-open maintaining means inside the sliding door to maintain the open state of the door has been disclosed and widely used. Moreover, the locking controller, the inner handle and the outer handle have been under study in many directions to control the operation of the door-open maintaining means.

For an example, a sliding door control assembly is disclosed in U.S. Pat. No. 5,605,363 assigned to Chrysler Corporation. In such sliding door control assembly, if the outer handle is pulled, the door-open maintaining means and the door-close maintaining means are simultaneously released. If the passenger grasps the inner handle and presses a button mounted on the inner handle, the door-open maintaining means and the door-close maintaining means are simultaneously released.

In case of the outer handle, as the passenger, who stands outside, operates the outer handle, the operation of the handle is natural. However, in case of the inner handle, as the passenger must slide the door to open or shut in a small area of the inside of the car while grasping the inner handle with one hand and pressing the button, thereby it is very difficult and complicate in releasing the sliding door.

For another example, a method that the door-open maintaining means and the door-close maintaining means are released simultaneously when the inner handle is pulled in the same way as the outer handle has been also disclosed and used. However, the method is more complicate in releasing the sliding door than the sliding door control assembly disclosed in U.S. Pat. No. 5,605,363.

Therefore, to solve the above problem, an attempt has been made as follows. The inner handle is mounted on a housing of an inner handle assembly in such a manner that the inner handle rotates in both directions, and is resiliently returned to a neutral position by an inner handle operation controlling means, and thereby when the inner handle is turned into the door opening direction or into the door closing direction, the inner handle is turned from the neutral position to the door opening direction or the door closing direction, such that the door-open maintaining means and the door-close maintaining means are released.

SUMMARY OF THE INVENTION

It is, therefore, an object of the present invention to provide a locking controller of a sliding door, which is operated in connection with an inner handle resiliently returned to a neutral position while turned into a door opening direction or into a door closing direction, thereby controlling a gripped condition of a door-open maintaining means or a door-close maintaining means.

To achieve the above object, the present invention provides a locking controller of a sliding door comprising: a housing having a plurality of coupling parts and guide holes; an inner handle link connected to the inner handle through the medium of a power transmission member such as a rod and a link, the inner handle link being rotatably fixed to the housing in both directions on a hinge shaft (F); an operation controlling link rotatably fixed to the housing on the hinge shaft (F), the operation controlling link being rotated in a clockwise direction by the inner handle link when being rotated in the clockwise direction of the inner handle link, the operation controlling link being returned to the original position by the restitutive force of a spring;

a link for a door-close maintaining means connected to the door-close maintaining means through the medium of the power transmission member such as the rod and the link, the link for the door-close maintaining means being rotatably fixed to the housing on the hinge shaft, the link for the door-close maintaining means being selectively connected to the operation controlling link through the medium of a door locking means connected to the operation controlling link to be rotated in the clockwise direction when being rotated in the clockwise direction of the inner handle link, the link for the door-close maintaining means being returned to the original position by the operation controlling link;

a link for a door-open maintaining means rotatably fixed to the housing on a hinge shaft (M), the link for the door-open maintaining means being connected to the door-open maintaining means through the medium of another power transmission member such as a cable, the link for the door-open maintaining means being rotated in the clockwise direction by the inner handle link when being rotated in a counterclockwise direction of the inner handle link, the link for the door-open maintaining means be returned to the original position by the restitutive force of another spring;

an outer handle means directly connected to the outer handle or indirectly connected to the outer handle through the medium of a separate power transmission member, the outer handle means being connected to the operation controlling link and the link for the door-open maintaining means, wherein if the outer handle is pulled or turned back, the outer handle means rotates the operation controlling link and the link for the door-open maintaining means to release the door-close maintaining means and the door-open maintaining means from a gripped state; and a door locking means connected to a door locking knob through the medium of another power transmission member such as a rod and a link, the door locking means being rotatbly mounted on the housing, the door locking means being connected to the operation controlling link in a movable manner to selectively stop the power transmission to the link for the door-close maintaining means from the operation controlling link.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
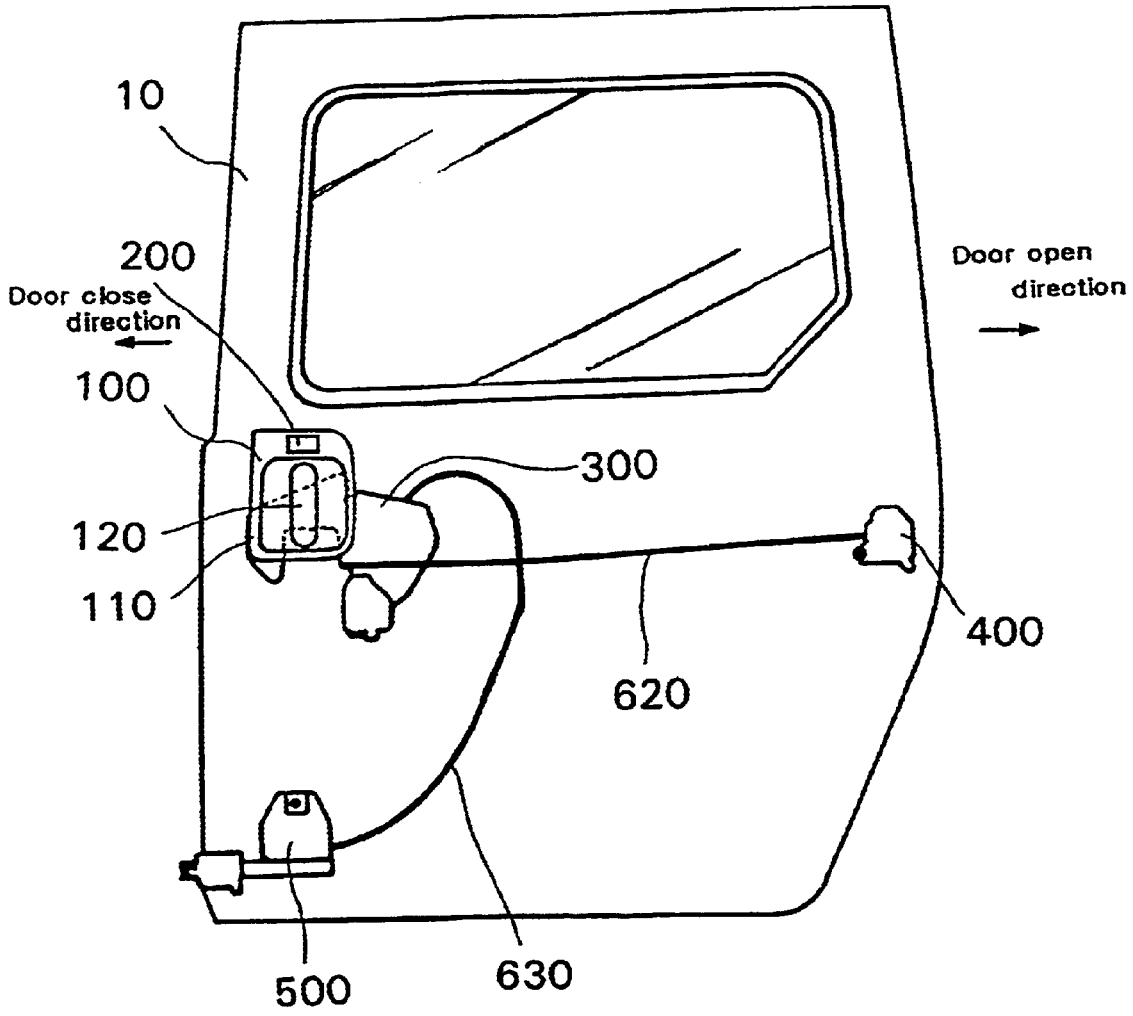
FIG. 1 is a schematic view of a sliding door opening and shutting device having a locking controller according to the present invention.

The present invention will now be described in detail in connection with preferred embodiments with reference to the accompanying drawings. For reference, like reference characters designate corresponding parts throughout several views.

FIG. 1 is a schematic view of a sliding door opening and shutting device having a locking controller according to the present invention. In FIG. 1, the sliding door opening and shutting device includes a door-close maintaining means 400 for maintaining a closed state of a sliding door 10, a door-open maintaining means 500 for maintaining an open state of the sliding door 10, a locking controller 300 connected to the door-close maintaining means 400 and the door-open maintaining means 500 to control the operation of the maintaining means 400 and 500, inner handle assembly 100 and outer handle assembly (not shown) actuating the locking controller 300 to selectively release the closed state of the sliding door 10, and a door locking knob 200 connected to the locking controller 300 to control the operation of the locking controller 300.

The connected operation of the components of the sliding door opening and shutting device will be described briefly. When an inner handle 120 of the inner handle assembly and an outer handle 363 of the outer handle assembly are operated, the locking controller 300 connected to the handles is also operated, such that the door-close maintaining means 400 and the door-open maintaining means 500 are selectively released by the locking controller 300. When the door locking knob 200 is operated, the locking controller 300 connected to the door locking knob 200 is controlled in the operation, such that the operation of the locking controller 300 by the inner handle 120 and the outer handle 363 is selectively stopped.

Here, the inner handle assembly shown in FIG. 1 includes a housing 110 having a plurality of coupling parts and/or built-up projections and being assembled inside the sliding door 10 through the medium of a locking member such as a screw, the inner handle 120 hinged in a rotatable manner in both directions, and an inner handle operation controlling means (not shown) for controlling the operation of the inner handle 120 to always return the inner handle 120 in a neutral position. If the inner handle 120 is pulled or pushed in a door opening direction in the state that the sliding door 10 is closed, the inner handle 120 is turned from the neutral position to the door opening direction and the door-close maintaining means 400 is released by the locking controller 300. If the inner handle 120 is pulled or pushed in the door closing direction in the state that the sliding door 10 is open, the inner handle 120 is turned from the neutral position to the door closing direction and the door-open maintaining means 500 is released by the locking controller 300.

Figure 2A:
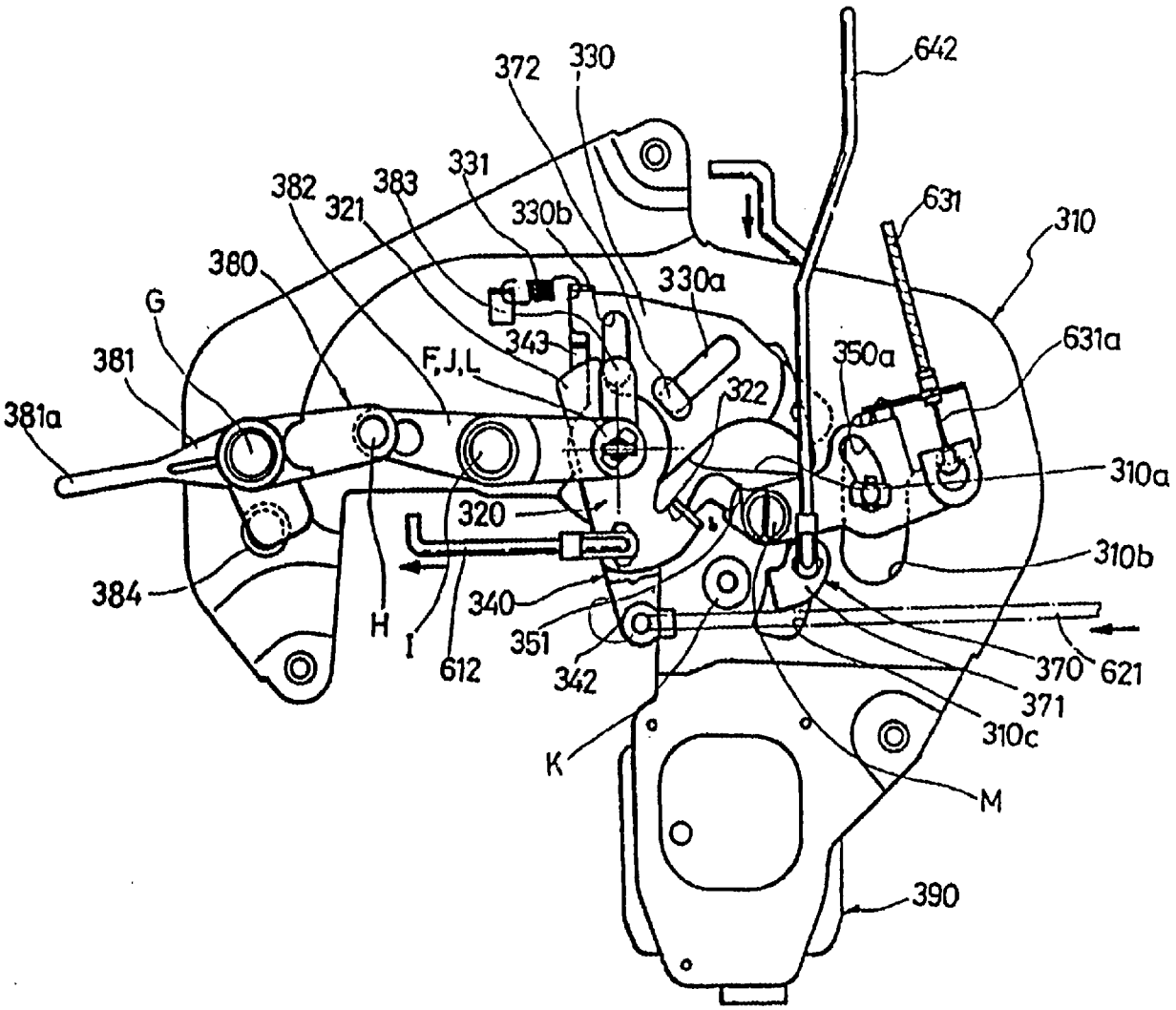
FIG. 2*a* is a front view of a preferred embodiment of the locking controller according to the present invention shown in FIG. 1.
Figure 2B:
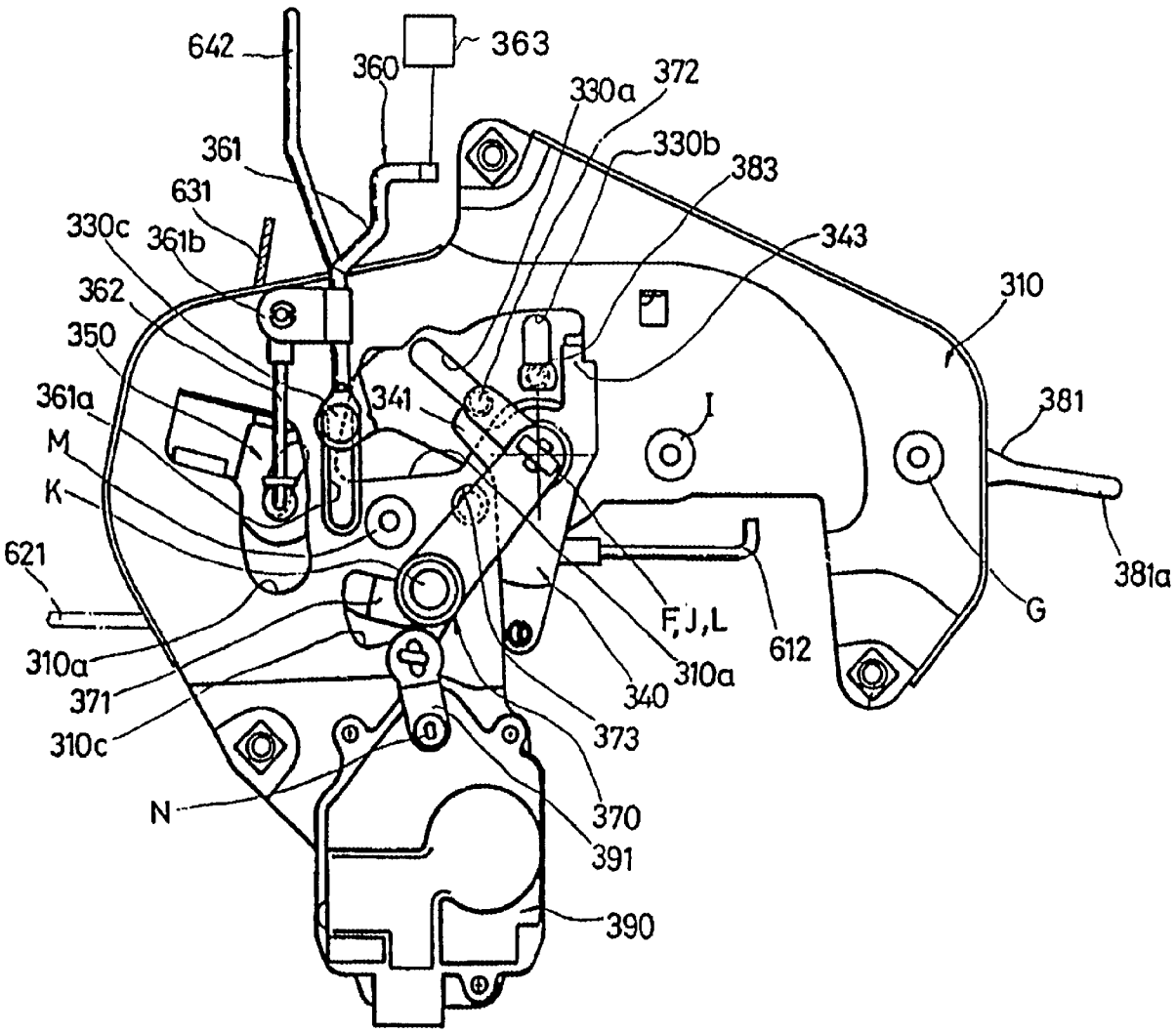
FIG. 2*b* is a rear view of FIG. 2*a*.

FIG. 2*a* is a front view of a preferred embodiment of the locking controller according to the present invention shown in FIG. 1 and FIG. 2*b* is a rear view of FIG. 2*a*. The locking controller 300 includes a housing 310 having a plurality of coupling parts and guide holes 310*a*, 310*b* and 310*c*, an inner handle link 320, an operation controlling link 330 and a link 340 for the door-close maintaining means which rotate on a hinge shaft (F), a link 350 for the door-open maintaining means which rotates on a hinge shaft (M), an outer handle means 360 reciprocating vertically, a door locking means 370 rotating on a hinge shaft (K), a door-open preventing means 380 rotating on a hinge shaft (G), and an actuator 390 for electrically controlling the operation of the door locking means 370. The components are constructed to operate in connection with each other.

The arrangement and the structure of the components applied to the present embodiment will be described in more detail. First, the inner handle link 320 is rotatably fixed on the front surface of the housing 310 on the hinge shaft (F) and connected at the inner handle 120 to be interlocked with each other through the medium of a power transmission member (not shown generally) including a rod 612 and a link (not shown).

The operation controlling link 330 includes a first guide hole 330*a*, a second guide hole 330*b* and a fixed projection 330*c* formed at an end. The operation controlling link 330 is rotatably fixed between the housing 310 and the inner handle link 320 through the medium of the hinge shaft (F). The fixed projection 330*c* is projected to the back of the housing 310 through the first guide hole 310*a* formed in the housing 310 and resiliently supported through the medium of a coil spring 331.

The link 340 for the door-close maintaining means is rotatably fixed on the rear surface of the housing 310 on the hinge shaft (F) and connected to the door-close maintaining means 400 through the medium of a power transmission member 620 (see FIG. 1) including a rod 621 and a link (not shown). A rod connecting part 342 located at an end of the link 340 for the door-close maintaining means is projected to the front of the housing 310 in such a manner that a bent surface of the rod connecting part 342 is in contact with a thick portion of the housing 310. A stopper 343 is formed at the other end of the link 340 positioned at the rear portion of the housing 310 and passes and inserted between the operation controlling link 330 adjacent to the connecting portion of the coil spring 331 and the first guide hole 310*a*. A fixed projection 341 is projected between the rod connecting part 342 and the stopper 343 and located at the rear portion of the housing 310. The fixed projection 341 is located parallel to a sliding surface of the first guide hole 330*a* of the operation controlling link 330.

The link 350 for the door-open maintaining means is rotatably fixed on the front surface of the housing 310 on the hinge shaft (M), connected to the door-open maintaining means 500 through the medium of a power transmission member 630 (see FIG. 1) such as a cable 631 and is resiliently fixed on the hinge shaft (M) through the medium of a torsion spring 351. A guide hole 350*a* is formed in the link 350 to insert and fix an auxiliary rod 362 of the outer handle means 360 in a movable manner.

The outer handle means 360 includes an outer handle connecting rod 361 and the auxiliary rod 362. The outer handle connecting rod 361 has a guide hole 361*a* formed at the lower end portion and a coupling part 361*b* projected to one side of the external surface. A fixed projection 330*c* of the operation controlling link 330 is inserted and fixed into the guide hole 361*a* in a movable manner. The upper end portion of the outer handle connecting rod 361 is directly connected to the outer handle 363 or indirectly connected through the medium of additional power transmission member (not shown), and located at the rear portion of the housing 310. The auxiliary rod 362 has an end hinged on the locking part 361*b* of the outer handle connecting rod 361 and the other end bent toward the front portion of the housing 310 and passing through the second guide hole 310*b* of the housing 310. The other end of the auxiliary rod 362 is inserted and fixed into the guide hole 350*a* of the link 350 for the door-open maintaining means.

The door locking means 370 includes a knob connecting link 371, a locking member 372 and the torsion spring 373. The knob connecting link 371 is rotatably fixed at the rear portion of the housing 310 on the hinge shaft (K) and connected to the door locking knob 200 through the medium of a power transmission member (not shown generally) including a rod 642 and a link (not shown). The door locking means 370 has an end on which the rod 642 is hinged in a rotatable manner. The end of the door locking means 370 is bent to be projected to the front portion of the housing 310 while passing through the third guide hole 310*c* of the housing 310. The locking member 372 has an end rotatably fixed at the other end of the knob connecting link 371, which is located at the rear portion of the housing 310 on a hinge shaft (L), and the other end passing through the first guide hole 310*a* of the housing 310 and being inserted and fixed into the first guide hole 330*a* of the operation controlling link 330 in a movable manner. The torsion spring 373 has both ends fixed to the housing 310 and the knob connecting link 371, and thereby the operation of the knob connecting link 371 is performed moderately.

The door-open preventing means 380 includes first and second links 381 and 382, the locking member 383 and the torsion spring 384. The first link 381 is rotatably fixed on the front surface of the housing 310 on a hinge shaft (G) and has a grip part 381*a* formed at a front end. The second link 382 is rotatably fixed on the front surface of the housing on a hinge shaft (I). The second link 382 has an end rotatably fixed at the other end of the grip part 381*a* of the first link 381 on a hinge shaft (H). The locking member 383 has an end rotatably fixed at the other end of the second link 382 on a hinge shaft (J) located in the opposite side of a hinge shaft (H) and the other end passing an end 321 of the inner handle link 320 and being inserted and fixed into the second guide hole 330*b* of the operation controlling link 330 in a movable manner. The other end of the locking member 383 is located in the first guide hole 310*a* of the housing 310. The torsion spring 384 has both ends fixed on the housing 310 and the first link 381 to perform the operation of the first link 381 moderately. This embodiment has two links 381 and 382 constituting the door-open preventing means 380. However, it will be appreciated that one link is rotatably fixed at the front surface of the housing 310 on the hinge shaft, a grip part 381*a* is formed at one end of the link and a locking member 383 is mounted at the other end through the medium of the hinge shaft (J), thereby the operation of the locking member 383 can be controlled by one link.

The actuator 390 of the housing 310 has an end fixed at a driving shaft (N) and the other end connected to the knob connecting link 371 through the medium of an actuator connecting member 391, which is rotatably fixed on the knob connecting link 371 on a hinge shaft (O).

Meanwhile, The structure and the operation of the door-close maintaining means 400 and the door-open maintaining means 500 have been widely known. Therefore the description of the structure and the operation of the door-close maintaining means 400 and the door-open maintaining means 500 will be omitted.

FIGS. 2*a* and 2*b* illustrate the locking controller 300 in an OFF state of the door locking knob 200 and the door-open preventing means 380. Under this condition, supposing that the sliding door 10 is closed, the operation condition of the sliding door opening and shutting device will be described.

In the state that the sliding door 10 is closed, if the passenger turns the inner handle 120 by pushing or pulling it in the door opening direction, the rod 612 of the locking controller 300 connected to the inner handle 120 is pulled and the inner handle link 320 is rotated in the clockwise direction (see FIG. 2*a*) on the rotary axis (F). At this time, the front end 321 of the inner handle link 320 pushes the locking member 383 of the door-opening preventing means 380 in the clockwise direction, such that the locking member 383 is rotated in the clockwise direction on the rotary axis (J) and the operation controlling link 330 is rotated in the clockwise direction on the rotary axis (F). The locking member 372 of the door locking means 370 pushes the fixed projection 341 of the link 340 for the door-close maintaining means in the clockwise direction while rotating in the clockwise direction on the rotary axis (L) by the operation controlling link 330, and thereby the link 340 for the door-close maintaining means is rotated in the clockwise direction on the rotary axis (F). At this time, the fixed projection 330*c* of the operation controlling link 330 reciprocates along the guide hole 361*a* of the outer handle connecting rod 361. Therefore, the rod 621 connected to the rod connecting part 342 of the link 340 for the door-close maintaining means is pulled, and the door-close maintaining means 400 connected to the rod 621 is released from the interlock, and thereby the sliding door 10 is opened.

After that, if the sliding door 10 is opened continuously and reaches a prescribed position, the door-open maintaining means 500 is interlocked with the car structure, and thereby the open state of the sliding door 10 can be maintained by the door-open maintaining means 500.

Meanwhile, if the passenger takes the hand off the inner handle 120, the inner handle 120 is returned to the neutral position by the inner handle operation controlling means. Furthermore, the operation controlling link 330 is rotated in the counterclockwise direction by the restitutive force of the coil spring 331 to be returned to the original position. The locking member 372 of the door locking means 370 inserted and fixed into the first guide hole 330*a* of the operation controlling link 330 and the locking member 383 of the door-open preventing means 380 inserted and fixed into the second guide hole 330*b* of the operation controlling link 330 are also rotated in the counterclockwise direction to be returned to the original position. The stopper 343 of the link 340 for the door-close maintaining means and the front end 321 of the inner handle link 320 put on the locking members 372 and 383 are pushed in the counterclockwise direction, and thereby the link 340 for the door-close maintaining means and the inner handle link 320 are rotated in the counterclockwise direction to be returned to the original position. Therefore, the rod 621 connected to the rod connecting part 342 of the link 340 for the door-close maintaining means is pushed, such that the door-close maintaining means 400 connected to the rod 621 is in a gripping wait condition.

Meanwhile, in case that the sliding door 10 maintains the open state by the door-open maintaining means 500, if the passenger pulls or pushes the inner handle 120 in the door closing direction, the rod 612 of the locking controller 300 connected to the inner handle 120 is pushed such that the inner handle link 320 is rotated in the counterclockwise direction (see FIG. 2*a*) on the rotary axis (F), and the other end 322 of the inner handle link 320 pushes one end of the link 350 for the door-open maintaining means such that the link 350 for the door-open maintaining link is rotated in the clockwise direction on the rotary axis (M). At this time, the wire 631 of the cable 631 connected to the link 350 for the door-open maintaining means is pulled and the door-open maintaining means 500 connected to the wire 631 is released from the gripped condition, and thereby the sliding door 10 can be moved in the door closing direction. At this time, the lower end of the auxiliary rod 362 inserted and fixed into the guide hole 350*a* of the link 350 for the door-open maintaining means maintains the stationary state and the link 350 for the door-open maintaining means having the guide hole 350*a* is rotated on the rotary axis (M).

After that, if the sliding door 10 is continuously moved in the door closing direction and reaches the door-shut position, the door-close maintaining means 400 is gripped, such that the sliding door 10 maintains the closed state by the door-close maintaining means 400.

Furthermore, when the outer handle 363 of the sliding door 10 is operated, the outer handle connecting rod 361 is pressed downward such that the auxiliary rod 362 connected to the connecting rod 361 is also pressed downward, and thereby the operation controlling link 330 contacted to the upper end of the guide hole 361*a* of the outer handle connecting rod 361 and the link 350 for the door-open maintaining means having the guide hole 350*a* contacted to the lower end of the auxiliary rod 362 are pushed downward by the outer handle connecting rod 361 and the auxiliary rod 362 at the same time. While the operation controlling link 350, the locking member 372 of the door locking means 370 and the link 340 for the door-close maintaining means are rotated in the clockwise direction, the link 350 for the door-open maintaining means is rotated in the clockwise direction, and thereby the door-close maintaining means 400 and the door-open maintaining means 500 are released at the same time.

In the state shown in FIGS. 2*a* and 2*b*, if the passenger turns on the door locking knob 200, the door locking knob 200 is rotated in the door opening direction, such that the rod 642 of the locking controller 300 connected to the door locking knob 200 is pushed downward and the knob connecting link 371 of the door locking means 370 is rotated in the clockwise direction (see FIG. 2*a*) on the hinge shaft (K). A hinge shaft (L) provided on the front end of the knob connecting link 371 arranged at the rear portion of the housing 310 is moved in the clockwise direction (in the counterclockwise direction in FIG. 2*b*) and pushes the locking member 372, and thereby the locking member 372 is raised up along the first guide hole 330*a* of the operation controlling link 330. The torsion spring 373 having both ends fixed at the knob connecting link 371 and the housing 310 respectively is changed in the position of both ends from the center of the torsion spring 373, thereby resiliently supporting the knob connecting link 371 to perform the operation of the knob connecting link 371 moderately. The door locking knob 200 maintains the ON state by the torsion spring 373.

Hereinafter, the operation of the sliding door opening and shutting device under the condition that the door locking knob 200 is turned on will be described.

First, in the state that the sliding door 10 is closed, if the passenger pushes or pulls the inner handle 120 in the door opening direction, the rod 612 of the locking controller 300 connected to the inner handle 120 is pulled, such that the inner handle link 320 is rotated in the clockwise direction (see FIG. 2*a*) on the rotary axis (F). After that, the front end 321 of the inner handle link 320 pushes the locking member 383 of the door-open preventing means 380 in the clockwise direction, such that the locking member 383 is rotated in the clockwise direction on the rotary axis (J) and the operation controlling link 330 is rotated in the clockwise direction on the rotary axis (F). The locking member 372 of the door locking means 370 is rotated in the clockwise direction on the rotary axis (L) by the operation controlling link 330. At this time, since the locking member 372 is in the state of being raised up along the first guide hole 330*a* of the operation controlling link 330 and separated from the fixed projection 341 of the link 340 for the door-close maintaining means, the power transmission to the link 340 for the door-close maintaining means is stopped and the link 340 for the door-close maintaining means can maintain the closed state. Therefore, even though the inner handle 120 is turned in the door opening direction in the state that the door locking knob 200 is turned on, the sliding door 10 is not opened.

Meanwhile, in the state that the sliding door 10 is opened to a prescribed position and the door-open maintaining means 500 is gripped, if the passenger pushes or pulls the inner handle 120 in the door closing direction, the inner handle link 320 is rotated in the counterclockwise direction (see FIG. 2*a*) on the rotary axis (F). In this case, the inner handle link 320 is not interfered with any components and the link 350 for the door-open maintaining means is interlocked with the inner handle link 320 without regard to the door locking means 370, and thereby the door-open maintaining means 500 is released from the gripped state and the sliding door 10 can move in the door closing direction. After that, when the sliding door 10 reaches the door-shut position, the door-close maintaining means 400 is gripped, and thereby the sliding door 10 maintains the closed state. Therefore, the shut sliding door 10 is not opened even though the inner handle 12 is turned into the door opening direction.

Furthermore, if the outer handle 363 of the sliding door 10 is operated, the outer handle connecting rod 361 is pressed downward and the auxiliary rod 362 connected to the outer handle connecting rod 361 is also pressed downward. The operation controlling link 330 contacted with the upper end of the guide hole 361*a* of the outer handle connecting rod 361 and the link 350 for the door-open maintaining means having the guide hole 350*a* contacted with the lower end of the auxiliary rod 362 are pushed downward at the same time by the outer handle connecting rod 361 and the auxiliary rod 362, and thereby the operation controlling link 350 and the locking member 372 of the door locking means 370 are rotated in the clockwise direction and the link 350 for the door-open maintaining means is rotated in the clockwise direction. Since the power transmission to the door-close maintaining means 400 is stopped, the door-open maintaining means 500 is released from the gripped state and the door-close maintaining means 400 maintains the gripped state.

In the state of FIGS. 2*a* and 2*b*, if the passenger raises up a grip part 381*a* of the door-open preventing means 380 and turns on the door-open preventing means 380, the first link 381 is rotated in the clockwise direction (see FIG. 2*a*) on the hinge shaft (G) and the second 382 engaging the first link 381 through the medium of the hinge shaft (H) is rotated in the counterclockwise direction to push the locking member 383 upward. The locking member 383 is raised up along the second guide hole 330*a* of the operation controlling link 330. The torsion spring 384 having both ends fixed at the first link 381 and the housing 310 respectively is changed in the position of both ends from the center of the torsion spring 384, thereby resiliently supporting the first link 381 to perform the operation of the first link 381 moderately. The door-open preventing means 380 maintains the ON state by the torsion spring 384.

Hereinafter, the operation of the sliding door opening and shutting device under the condition that the door-open preventing means 380 is turned on will be described.

First, in the state that the sliding door 10 is closed, if the passenger pushes or pulls the inner handle 120 in the door opening direction, the rod 612 of the locking controller 300 connected to the inner handle 120 is pulled, such that the inner handle link 320 is rotated in the clockwise direction (see FIG. 2*a*) on the rotary axis (F). At this time, since the locking member 383 is in the state of being raised up along the second guide hole 330*a* of the operation controlling link 330 and separated from the upper end 321 of the inner handle link 320, the power transmission to the operation controlling link 330 through the medium of the locking member 383 is stopped and the operation controlling link 330 and the link 340 for the door-close maintaining means can maintain the stopped state. Therefore, even though the inner handle 120 is turned into the door opening direction in the state that the door locking knob 200 is on, the sliding door 10 is not opened.

Meanwhile, in the state that the sliding door 10 is opened to a prescribed position and the door-open maintaining means 500 is gripped, if the passenger pushes or pulls the inner handle 120 in the door closing direction, the inner handle link 320 is rotated in the counterclockwise direction (see FIG. 2*a*) on the rotary axis (F). In this case, the inner handle link 320 is not interfered with any components and the link 350 for the door-open maintaining means is interlocked with the inner handle link 320 without regard to the door-open preventing means 380, and thereby the door-open maintaining means 500 is released from the gripped state and the sliding door 10 can move in the door closing direction. After that, when the sliding door 10 reaches the door-shut position, the door-close maintaining means 400 is gripped, and thereby the sliding door 10 maintains the closed state. Therefore, the shut sliding door 10 is not opened even though the inner handle 12 is turned into the door opening direction.

Furthermore, if the outer handle 363 of the sliding door 10 is operated, the outer handle connecting rod 361 is pressed downward and the auxiliary rod 362 connected to the outer handle connecting rod 361 is also pressed downward. The operation controlling link 330 contacted with the upper end of the guide hole 361*a* of the outer handle connecting rod 361 and the link 350 for the door-open maintaining means having the guide hole 350*a* contacted with the lower end of the auxiliary rod 362 are pushed downward at the same time by the outer handle connecting rod 361 and the auxiliary rod 362, and thereby the operation controlling link 350, the locking member 372 of the door locking means 370 and the link 340 for the door-close maintaining means are rotated in the clockwise direction and the link 350 for the door-open maintaining means is rotated in the clockwise direction. Therefore, the door-close maintaining means 400 and the door-open maintaining means 500 are released at the time without regard to the ON/OFF state of the door-open preventing means 380.

When being turned in the door opening direction or in the door closing direction, the locking controller 300 according to the present invention is operated in connection with the inner handle 120 resiliently returned to the neutral position, thereby controlling the gripped condition of the door-open maintaining means and the door-close maintaining means properly.

Moreover, the locking controller 300 of the present invention can open and shut the sliding door 10 by the outer handle 363, operate in connection with the safety devices such as the door locking knob 200 or the door-open preventing means 380 and operate in connection with the actuator 390. Therefore, the locking controller 300 according to the present invention has all functions of the well-known sliding door opening and shutting devices.

As previously described, the locking controller according to the present invention operates in connection with the inner handle resiliently returned to the neutral position while being turned in the door opening direction or in the door closing direction, thereby pulling or pushing the inner handle in the door opening direction in the state that the sliding door is closed. When being pulled or pushed in the door opening direction, the inner handle is turned into the door opening direction from the neutral position to release the door-close maintaining means. When being pulled or pushed in the door closing direction in the state that the sliding door is opened, the inner handle is turned into the door closing direction from the neutral position to release the door-open maintaining means.

Therefore, the present invention has an effect that if the passenger operates the inner handle in one direction (in the door opening direction or in the door closing direction), the door-close maintaining means or the door-open maintaining means of the sliding door is released from the gripped state, and thereby the sliding door is opened or shut.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A locking controller of a sliding door comprising:

a housing having a plurality of coupling parts and guide holes;

an inner handle link directly connected to an inner handle through a power transmission member, the inner handle link being rotatably fixed to the housing on a first hinge shaft (F);

an operation controlling link rotatably fixed to the housing on the first hinge shaft (F), the operation controlling link being rotatable in a clockwise direction by the inner handle link, the operation controlling link being urged into an original position by a restitutive force of a spring spaced from the first hinge shaft;

a link connected to a door-close maintaining mechanism through a power transmission member, the door-close maintaining mechanism link being rotatably fixed to the housing on the first hinge shaft, the door-close maintaining mechanism link being selectively connected to the operation controlling link through a door locking mechanism connected to the operation controlling link such that said door-close maintaining mechanism link can be rotated in the clockwise direction by said operation controlling link, the door-close maintaining mechanism link being returned to an original position by the operation controlling link;

a link for a door-open maintaining mechanism rotatably fixed to the housing on a second hinge shaft (M), the door-open maintaining mechanism link being connected to the door-open maintaining mechanism through another power transmission member comprising a cable, the door-open maintaining mechanism link being rotated in the clockwise direction directly by the inner handle link rotated in a counterclockwise direction, the door-open maintaining mechanism link being urged into an original position by restitutive force of another spring;

an outer handle mechanism operatively connected to an outer handle, the outer handle mechanism being connected to the operation controlling link and the door-open maintaining mechanism link, wherein if the outer handle is pulled, the outer handle mechanism rotates the operation controlling link and the door-open maintaining mechanism link to release the door-close maintaining mechanism and the door-open maintaining mechanism from a gripped state; and the door locking mechanism connected to a door locking knob through another power transmission member, the door locking mechanism being rotatably mounted on the housing, the door locking mechanism being connected to the operation controlling link in a movable manner to selectively stop a transmission of power to the door-close maintaining mechanism link from the operation controlling link.

2. The locking controller as claimed in claim 1, wherein a transmission of power from the inner handle link to the operation controlling link is selectively stopped by operating a door-open preventing mechanism, the door-open preventing mechanism being rotatably mounted on the housing.

3. The locking controller as claimed in claim 1, wherein the housing includes an actuator and the door locking mechanism is rotatably connected to the actuator through an actuator connecting member, such that operation of the door locking mechanism is automatically controlled by the actuator which is controlled by an electric signal.

* * * * *